US005463275A

United States Patent [19]

Chen et al.

[11] Patent Number: 5,463,275

[45] Date of Patent: Oct. 31, 1995

[54] HETEROJUNCTION STEP DOPED BARRIER CATHODE EMITTER

[75] Inventors: Chung-Hsu Chen; Huan-Chun Yen, both of Torrance, Calif.

[73] Assignee: TRW Inc., Redondo Beach, Calif.

[21] Appl. No.: 911,581

[22] Filed: Jul. 10, 1992

[51] Int. Cl.[6] ..... H01J 1/30

[52] U.S. Cl. ..... 313/495; 257/10

[58] Field of Search ..... 313/495, 346 R, 313/499; 257/191, 192, 194, 10, 11

[56] References Cited

U.S. PATENT DOCUMENTS

| | | | |
|---|---|---|---|
| 4,063,269 | 12/1977 | Hara et al. | 257/11 |
| 4,683,399 | 7/1987 | Soclof | 313/495 |
| 4,691,215 | 9/1987 | Luryi | 257/191 |
| 4,727,403 | 2/1988 | Hida et al. | 257/194 |
| 4,801,982 | 1/1989 | Couch et al. | 257/11 |
| 4,801,994 | 1/1989 | Van Gorkom et al. | 257/10 |
| 5,068,868 | 11/1991 | Deppe et al. | 257/11 |
| 5,285,079 | 2/1994 | Tsukamoto et al. | 257/10 |

FOREIGN PATENT DOCUMENTS

| | | | |
|---|---|---|---|
| 0331373 | 9/1989 | European Pat. Off. | 257/10 |
| 2109160 | 5/1983 | United Kingdom | 257/10 |

*Primary Examiner*—Tommy P. Chin
*Assistant Examiner*—Kara A. Farnandez

[57] ABSTRACT

This invention discloses an emitter for a vacuum microelectronic device. The emitter includes a heterojunction step-doped barrier comprised of a first gallium arsenide region, an aluminum gallium arsenide region adjacent the first gallium arsenide region, and a second gallium arsenide region adjacent the aluminum gallium region and opposite to the first gallium arsenide region. The first gallium arsenide region includes a layer of heavily doped n-type gallium arsenide. The aluminum gallium arsenide region includes an intrinsic layer and a heavily doped p-type layer. The second gallium arsenide region includes a heavily doped p-type layer adjacent the aluminum gallium arsenide region, an intrinsic layer and a heavily doped n-type layer adjacent a vacuum region. In addition, a graded layer between the first gallium arsenide layer region and the aluminum gallium arsenide region is provided. Ohmic contacts are fabricated on the outer surfaces of the first gallium arsenide layer and the second gallium arsenide layer. An appropriate potential is applied across the ohmic contacts such that most of the electrons from the first gallium arsenide region have enough kinetic energy to transcend the vacuum barrier potential and be emitted into the vacuum region.

16 Claims, 1 Drawing Sheet

HETEROJUNCTION STEP DOPED BARRIER CATHODE EMITTER

BACKGROUND OF THE INVENTION

1. Field of the Invention

This invention relates generally to a cathode emitter, and more particularly, to a semiconductor cathode emitter including a heterojunction step-doped barrier operable at a low bias as compared to that of a hot or cold cathode emitter in a typical vacuum tube device.

2. Discussion of the Related Art

As is known, a multitude of solid state electrical components can be incorporated on a single semiconductor wafer. In this configuration, the charge carriers for each of the components are transported through the semiconductor materials. For example, in a solid state bipolar transistor, the charge carriers between the emitter and collector of the transistor travel through the semiconductor material which makes up the emitter, base and collector. Because of this, circuit performance is limited by the maximum achievable charge carrier drift velocity through the semiconductor materials and the thermal dissipation generated due to the collisions of the carriers with the lattice structure of the semiconductor materials.

From cathode ray tube technology, it is known to incorporate an emitting cathode and a receiving anode in a vacuum chamber such that electrons are emitted from the cathode to the anode through the vacuum. In these devices, in order to generate the electron beam it is often necessary to heat the cathode to a relatively high temperature in order to give the electrons enough energy to overcome the vacuum potential barrier and be emitted from the cathode into the vacuum towards the anode. Consequently, a substantial amount of power is required to generate this heat. However, once the electrons are traveling through the vacuum, they are not hindered by lattice collisions. Obviously, many other factors, such as space charge effect, size requirements, heating drawbacks, power requirements, ease of integration, etc. generally make solid state devices more attractive than cathode ray tube in certain types of devices such as in microwave and millimeter-wave power generation.

One concept to overcome the performance limitations and drawbacks concerning carrier capabilities in semiconductors has been the proposal of a vacuum microelectronic cathode emitter which combines highly integrated solid state technology with high speed, high power vacuum tube technology. In a cathode emitter, the electrical charge carriers travel in a vacuum between the different semiconductor components of an electrical device, such as a transistor, incorporated on a single wafer. Theoretically then, a solid state device of this type can operate at a much higher frequency range and power level which otherwise could be attainable with a prior art solid state device. To achieve these results, however, and make a vacuum cathode emitter practical, it is desirable that the emitter be very efficient while operating at a low bias potential.

One emitter design has been proposed in the art which has attempted to satisfy the above described requirements in order to realize the advantages of a vacuum microelectronic device. This design has been referred to as a planar-doped barrier cathode emitter. In a planar-doped barrier cathode emitter, a semiconductor heterojunction emitter includes a single atomic sheet of acceptor atoms sandwiched between intrinsic layers of a semiconductor material such as AlGaAs. However, this emitter design has suffered low emitter efficiency due to few excessive hot electrons with kinetic energies above the vacuum barrier potential, thus resulting in limitations for a practical device.

What is needed then is a vacuum microelectronic emitter which is operable at a low bias potential, and which does not suffer the emitter efficiency problems of the above described prior art. It is therefore an object of the present invention to provide such a vacuum microelectronic emitter.

SUMMARY OF THE INVENTION

This invention discloses a heterojunction step-doped barrier cathode (HSDBC) as a cathode emitter for a vacuum microelectronic device. By application of a semiconductor heterojunction emitter, it is possible through band-gap engineering to raise the energy level of the conduction band of the emitter above the energy level of the vacuum potential under a proper bias. When the emitter is forward-biased, the conduction band is tilted upwards such that a high number of conduction electrons have an adequate kinetic energy in the normal direction to overcome the vacuum barrier potential, and thus, the emitter efficiency can be greatly increased.

In one particular embodiment, as described herein, the emitter is comprised of an aluminum gallium arsenide (AlGaAs) region sandwiched between two gallium arsenide (GaAs) regions. A first GaAs region is a heavily doped $n^+$ GaAs region which acts as a source of electrons. Adjacent the first GaAs region is the AlGaAs region which includes an intrinsic layer adjacent the first GaAs region and a heavily doped $p^+$ layer. Adjacent the AlGaAs region and opposite to the first GaAs layer is the second GaAs region. The second GaAs region includes, in order from the first GaAs region, a heavily doped $p^+$ GaAs layer adjacent an intrinsic GaAs layer which is adjacent a heavily doped $n^+$ GaAs layer acting as the contact layer at the outer surface of the emitter. This device structure can be considered as two diodes in a back-to-back arrangement.

By applying a bias potential across the emitter, one of the diodes is reverse-biased, and the energy of the conduction band is raised well above the vacuum level potential such that in a properly designed device a large percentage of the electrons which are released from the first GaAs region have enough perpendicular kinetic energy after traveling through the second GaAs region to surmount the vacuum level potential and be freed from the emitter.

Additional objects, advantages, and features of the present invention will become apparent from the following description and appended claims, taken in conjunction with the accompanying drawings.

DETAILED DESCRIPTION OF THE DRAWINGS

The following description of the preferred embodiments concerning a vacuum microelectronic cathode emitter is merely exemplary in nature and is in no way intended to limit the invention or its application or uses.

As mentioned above, in order for a vacuum emitter to be practical, it is very desirable that the emitter efficiency be high at a low emitter bias. In other words, a high percentage of the electrons which are injected into the emitter at a low bias potential must have enough energy to be emitted into a vacuum. By bandgap engineering of a heterojunction emitter, it is possible to raise the conduction band of the emitter to a level sufficient for efficient emitter operation. By creating an emitter structure comprised of a first diode (source diode) and a second diode (output diode), where the source diode is forward-biased and the output diode is reverse-biased, the conduction band energy can be raised. The source diode thus supplies a large quantity of the electron carriers for eventual emission. It is stressed that the specific parameters and materials described below are by way of a nonlimiting example.

Figure 1:
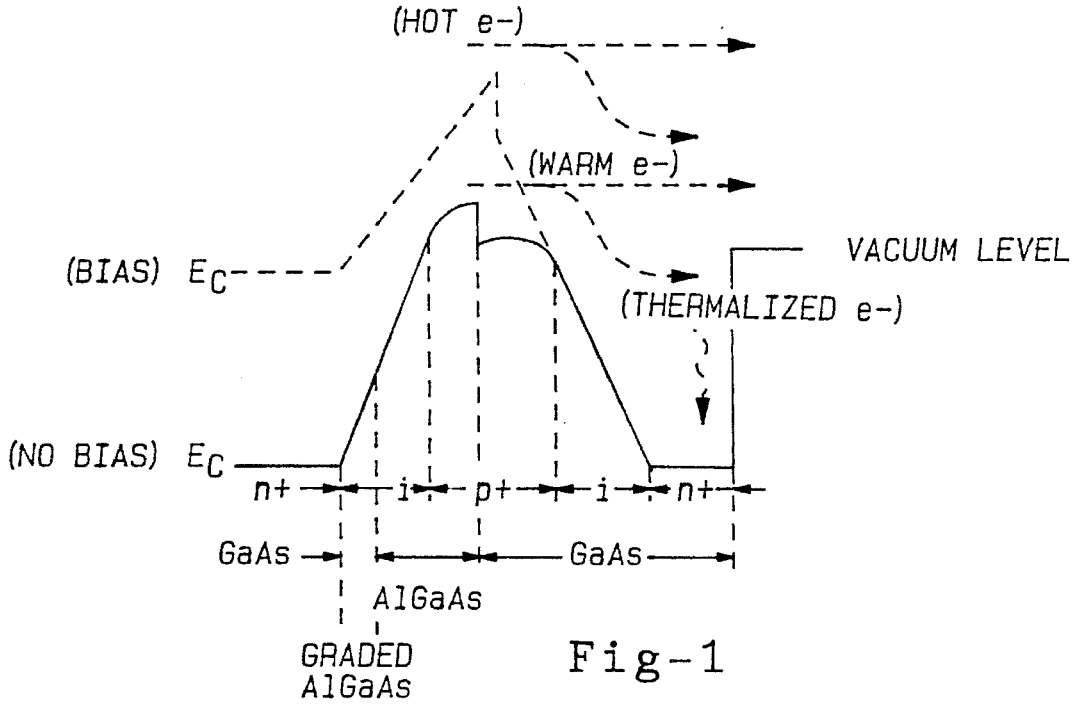
FIG. 1 is a conduction band diagram for a vacuum microelectronic cathode emitter according to one preferred embodiment of the present invention.

First turning to FIG. 1, a conduction band ($E_c$) diagram of a semiconductor cathode emitter which could be incorporated in a vacuum microelectronic device, such as a transistor, is shown. As is known, the conduction band represents the relative energy level of an electron with respect to a reference level, such as the vacuum level. If the conduction band energy is lower than the vacuum level, the electrons are bound inside the semiconductor material. On the other hand, if the conduction band energy is higher, there is a finite probability some of the electrons can move out of the semiconductor material. In fact, the larger the difference is between the electrons energy and the vacuum energy, the higher the emission probability. The electrons injected into the output diode under the forward bias of the source diode will see a steep potential drop due to the reverse-biased source diode, and will gain their kinetic energy at the expense of their potential energy. As is apparent, the device principle requires the conduction band be risen at some point to a level above the electron energy potential for the vacuum level. It is the vacuum level energy which an electron at least must have in its normal direction when it reaches the emitter surface in order to be emitted from the emitter with a high probability. To achieve this conduction band configuration, a step-doped heterojunction, according to one preferred embodiment, is proposed as will be discussed.

In this embodiment, a first heavily doped $n^+$ GaAs region is formed at the left and acts as a source of electrons. With no bias, the conduction band energy level for this region is considerably lower than the vacuum energy level. Adjacent the first heavily doped $n^+$ GaAs region is a graded layer, as shown. The graded layer is an AlGaAs layer with varying aluminum composition such that the transition from the first heavily doped $n^+$ GaAs region to an AlGaAs region is smooth for the conduction of electrons. In other words, by avoiding a sudden constituent change between the first GaAs region having no aluminum and the AlGaAs region having approximately 22% aluminum, electrons traveling from the first GaAs region to the AlGaAs region will suffer considerably less reflection as compared to a step-like potential caused by a sudden constituent change. In this regard, the graded layer is graded with aluminum such that it has substantially no aluminum at the interface with the first GaAs region and substantially the same percentage of aluminum as the AlGaAs region at the interface with the AlGaAs region. The AlGaAs region consists of an intrinsic layer adjacent to and including the graded layer, and a heavily doped $p^+$ layer adjacent the intrinsic layer and opposite to the graded layer. As is apparent, the $p^+$ AlGaAs layer under a reverse-biased condition can provide a conduction band energy above the vacuum energy level. The combination of the first GaAs region and the AlGaAs region make up the source diode.

Next, a second GaAs region is formed adjacent the AlGaAs region and opposite to the first GaAs region. The second GaAs region consists of a heavily doped $p^+$ layer adjacent the $p^+$ AlGaAs layer. This combination of $p^+$ layers forms the step-doped barrier crucial to achieve high emitter efficiency. Adjacent the heavily doped $p^+$ GaAs layer is a thin intrinsic GaAs layer, followed by a heavily doped $n^+$ GaAs layer opposite the heavily doped $p^+$ GaAs layer. The second GaAs region makes up the output diode.

GaAs is chosen for this second region in order to provide a substantially resistance free region for the electrons to travel from the first GaAs region to the vacuum area. In other words, the kinetic energy the electrons gained from the top of the conduction band will be substantially preserved as the electrons travel through the second GaAs region. It is noted that the heavily doped $n^+$ GaAs layer of the second GaAs region is a contact layer at the outer layer of the emitter, and as such is adjacent the vacuum area in which the emitter electrons are emitted into, as will be described.

For normal operation, the device design (thickness and doping) of the $p^+$ AlGaAs should be charge-balanced with the $n^+$ GaAs source layer, while the $p^+$ GaAs should be charge-balanced with the outer $n^+$ GaAs layer. By this bandgap engineering and proper biasing, the heavily doped $n^+$ regions are at the lowest conduction band energy level and the interface between the heavily doped $p^+$ layers of the confronting AlGaAs region and the second GaAs region are at the highest conduction band energy level. Further, the highest conduction band energy level is above the vacuum level potential, as shown.

The solid conduction band energy level ($E_c$) is at a no-bias potential or a very small bias. Normally, the conduction band maximum would be lower than the vacuum level. However, if the emitter surface is coated with a thin layer of material (not shown) with a low work function, it is possible to make the maximum conduction band slightly higher than the vacuum. For those electrons from the source region which do have enough energy to exist at the conduction band energy level maximum at the interface of the $p^+$ AlGaAs region and GaAs region, they may gain enough kinetic energy to drift through the second GaAs region and be emitted into the vacuum as shown by the solid straight line labeled warm $e^-$. However, most of these electrons will lose a portion of their energy by lattice collisions and so forth as they drift across the second GaAs region towards the vacuum area, and will thus be thermalized upon reaching the outer surface of the heavily doped $n^+$ region of the second GaAs region. These thermalized electrons eventually lose all the kinetic energy gained and are collected by the outer $n^+$ GaAs contact layer. This is shown by the solid thermalized $e^-$ line of FIG. 1.

If a predetermined forward bias potential is applied to the emitter such that the conduction band is tilted and raised, as shown by the dotted $E_c$ line, a large portion of the electrons, labeled here as hot $e^-$, will generally gain a net kinetic energy while traveling through the second GaAs region to the outer surface of the emitter adjacent the vacuum area. These electrons will generally have retained enough kinetic energy in the normal direction to be released from the emitter into the vacuum area, even though the electrons will lose some overall energy while traveling across the second GaAs region. This is depicted by the dotted hot $e^-$ line. By making the conduction band maximum much higher than the vacuum level through bandgap engineering and proper biasing, the emitter efficiency can be made high enough such that a practical application of a step-doped heterojunction emitter for a microelectronic device is possible.

Figure 2:
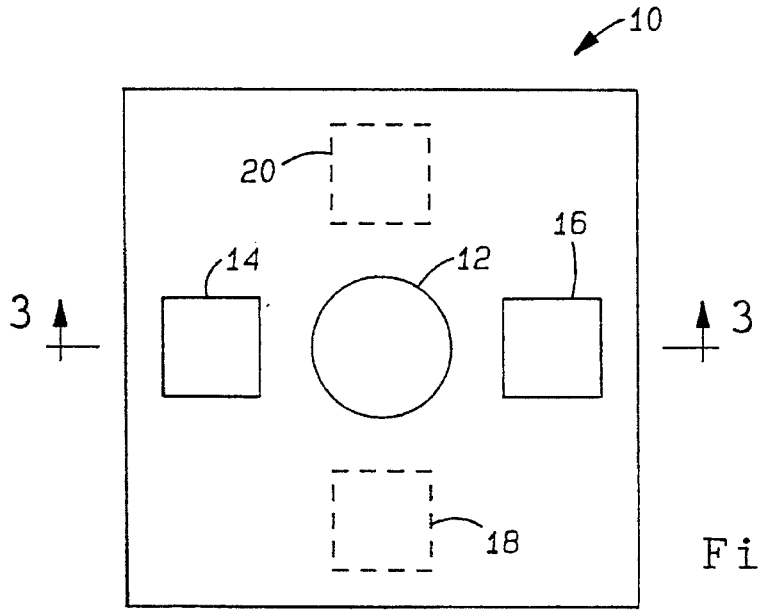
FIG. 2 is a top view of the emitter according to the preferred embodiment of FIG. 1.
Figure 3:
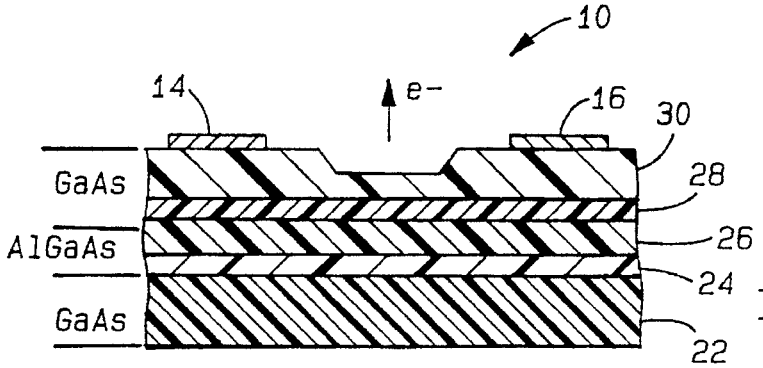
FIG. 3 is a cross section taken along line 3—3 of the emitter of FIG. 2.

Turning to FIGS. 2 and 3, a schematic of a physical representation of an emitter 10 incorporating the above described step-doped barrier heterojunction is shown. FIG. 2 shows a top view of emitter 10 and FIG. 3 shows a cut-away cross section view taken along line 3—3 of emitter 10 of FIG. 2. More particularly, emitter 10 includes an emitter head area 12, a top pair of ohmic contacts 14 and 16, and a bottom pair of ohmic contacts 18 and 20, as shown. Ohmic contacts 14 and 16 will be electrically connected to the second GaAs region, and ohmic contacts 18 and 20 will be electrically connected to the first GaAs region. Under operation, an appropriate bias potential is applied across the top ohmic contacts 14 and 16 and the bottom ohmic contacts 18 and 20 such that electrons are emitted into the vacuum region in the direction as depicted in FIG. 3.

FIG. 3 further shows a physical representation of the different layers and regions as discussed above for FIG. 1. More particularly, the different GaAs and AlGaAs regions are represented at the left of emitter 10, with the first GaAs region acting as a source at the bottom. In this regard, layer 22 represents the heavily doped $n^+$ layer of the first GaAs region having a thickness of approximately 1000 angstroms. Layer 24 represents the intrinsic layer comprised of the graded AlGaAs layer having a thickness of approximately 100 angstroms. Layer 26 represents the heavily doped $p^+$ AlGaAs and GaAs layers and has a thickness of approximately 200 angstroms. Layer 28 represents the intrinsic layer of the second GaAs layer having a thickness of approximately 100 angstroms. Layer 30 represents the heavily doped $n^+$ layer of the second GaAs region having a thickness of approximately 300 angstroms. Emitter head area 12 is the area between top ohmic contacts 14 and 16 which is the thinnest region of layer 30. In this regard, the electrons are emitted from emitter head area 12 because of the decrease in distance necessary to travel across layer 30, as a result of less lattice collisions. By this configuration, electrons can readily travel from layer 22 to be emitted from layer 30, as shown, under a bias potential.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims. Other thicknesses of the layers would be equally applicable without departing from the spirit of the invention.

What is claimed is:

1. A semiconductor device operable to be used in a vacuum microelectronic device, said semiconductor device comprising:

a first semiconductor region being substantially constituted of a first semiconductor material;

a second semiconductor region being positioned adjacent to and in contact with the first semiconductor region, said second region being substantially constituted of a second semiconductor material, wherein said second semiconductor region includes a p-type doped layer; and a third semiconductor region being substantially constituted of the first semiconductor material, said third semiconductor region being positioned adjacent to and in contact with the second semiconductor region and opposite to the first semiconductor region, said third semiconductor region including a p-type doped layer being positioned adjacent to and in contact with the p-type doped layer of the second semiconductor region, wherein a maximum conduction band energy level of the second semiconductor region is greater than a maximum conduction band energy level for the third semiconductor region and wherein the conduction band energy level of the p-type doped layer of the third semiconductor region is greater than a layer of the third semiconductor region adjacent to the p-type doped layer of the third semiconductor region such that the semiconductor device is operable to emit electrons from the third semiconductor region.

2. The emitter according to claim 1 wherein the first semiconductor region includes an n-type doped gallium arsenide semiconductor material.

3. The emitter according to claim 1 wherein the second semiconductor region includes an intrinsic aluminum gallium arsenide layer being positioned adjacent to the first semiconductor region and a p-type doped aluminum gallium arsenide layer being positioned adjacent to the intrinsic aluminum gallium arsenide layer and the third semiconductor region.

4. The emitter according to claim 1 wherein the third semiconductor region includes a p-type doped gallium arsenide layer being positioned adjacent to the second semiconductor region, an intrinsic gallium arsenide layer being positioned adjacent to the p-type doped gallium arsenide layer, and an n-type doped gallium arsenide layer being positioned adjacent to the intrinsic gallium arsenide layer and the vacuum area.

5. The emitter according to claim 1 wherein the second semiconductor region includes a graded region, said graded region being positioned adjacent to the first semiconductor region and graded to be substantially of the first semiconductor material at a surface adjacent to the first semiconductor region and the second semiconductor material at a surface opposite to the first semiconductor region.

6. The emitter according to claim 1 further comprising at least two ohmic contacts, one of said ohmic contacts being in electrical contact with the first semiconductor region and another of said ohmic contacts being in electrical contact with the third semiconductor region opposite to the first ohmic contact, wherein the ohmic contacts are operable to receive an electric potential such that electrons are emitted from the third semiconductor region.

7. A method of injecting electrons from a semiconductor emitter into a vacuum region, said method comprising the steps of:

providing a first region being substantially constituted of a first semiconductor material adjacent to the vacuum region, said step of providing a first region including providing p-type doped layer;

providing a second region being substantially constituted of a second semiconductor material adjacent to and in contact with the first region, said step of providing the second region including providing a p-type doped layer, wherein the p-type doped layer of the second region is adjacent to and in contact with the p-type doped layer of the first region;

providing a third region being substantially constituted of the first semiconductor material adjacent to and in contact with the second region and opposite to the first region;

providing a first contact being in electrical contact with the first region and adjacent to the vacuum region and providing a second contact being in electrical contact with the third region and opposite to the first contact; and applying a potential to the first and second contacts such that electrons are emitted from the first region into the vacuum region.

8. The method according to claim 7 wherein the step of providing a first region includes the steps of providing an n-type doped gallium arsenide region adjacent to the vacuum region, providing an intrinsic gallium arsenide layer adjacent to the n-type doped gallium arsenide layer, and providing a p-type doped gallium arsenide layer adjacent to the intrinsic gallium arsenide layer and opposite to the n-type doped gallium arsenide layer.

9. The method according to claim 7 wherein the step of providing the second region includes the steps of providing a p-type doped aluminum gallium arsenide layer adjacent to the first region and an intrinsic aluminum gallium arsenide layer adjacent to the p-type doped aluminum gallium arsenide layer and the third region.

10. The method according to claim 7 wherein the step of providing the third region includes the step of providing an n-type doped gallium arsenide layer adjacent to the second region.

11. The method according to claim 7 wherein the step of providing the second region includes the step of providing a graded semiconductor region adjacent to the third region, wherein the graded region is graded from the first semiconductor material adjacent to the third region to the second semiconductor material at a surface opposite to the third region.

12. A semiconductor emitter operable to be used in a vacuum semiconductor device, said emitter comprising:

a first gallium arsenide region, said first gallium arsenide region being an n-type doped semiconductor region;

an aluminum gallium arsenide semiconductor region, said aluminum gallium arsenide semiconductor region be being positioned adjacent to the first gallium arsenide region, said aluminum gallium arsenide region including an intrinsic aluminum gallium arsenide layer being positioned adjacent to the first gallium arsenide region and a p-type doped aluminum gallium arsenide layer being positioned adjacent to the intrinsic aluminum gallium arsenide layer; and a second gallium arsenide region, said second gallium arsenide region including a p-type doped gallium arsenide layer being positioned adjacent to the p-type doped aluminum gallium arsenide layer, an intrinsic gallium arsenide layer being positioned adjacent to the p-type doped gallium arsenide layer, and an n-type doped gallium arsenide layer being positioned adjacent to the intrinsic gallium arsenide layer and a vacuum area, wherein the emitter is operable to emit electrons into the vacuum area from the second gallium arsenide region.

13. The emitter according to claim 12 wherein the aluminum gallium arsenide layer includes a graded region, said graded region being positioned adjacent to the first gallium arsenide region, wherein the graded region is of graded aluminum such that the surface of the graded region adjacent the first gallium arsenide region includes substantially no aluminum.

14. The emitter according to claim 12 further comprising at least two ohmic contacts, one of said ohmic contacts being in electrical contact with the first gallium arsenide region and another of said ohmic contacts being in electrical contact with the second gallium arsenide region opposite to the first ohmic contact, wherein the ohmic contacts are operable to receive an electric potential such that electrons are emitted from the second gallium arsenide region into the vacuum area.

15. The emitter according to claim 12 wherein the first gallium arsenide region is approximately a thousand angstroms thick, the intrinsic aluminum gallium arsenide layer is approximately a hundred angstroms thick, the combination of the p-type aluminum gallium arsenide layer and the p-type gallium arsenide layer is approximately two hundred angstroms thick, the intrinsic gallium arsenide layer is approximately one hundred angstroms thick, and the n-type gallium arsenide layer is approximately three hundred angstroms thick.

16. A semiconductor device operable to be used in a vacuum microelectronic device, said semiconductor device comprising:

a first semiconductor region being substantially constituted of a first semiconductor material;

a second semiconductor region being positioned adjacent to and in contact with the first semiconductor region, said second region being substantially constituted of a second semiconductor material, wherein said second semiconductor region includes a p-type doped layer;

a third semiconductor region being substantially constituted of the first semiconductor material, said third semiconductor region being positioned adjacent to and in contact with the second semiconductor region and opposite to the first semiconductor region, said third semiconductor region including a p-type doped layer being positioned adjacent to and in contact with the p-type doped layer of the second semiconductor region; and first and second contacts, the first contact being in electrical contact with the first semiconductor region and the second contact being in electrical contact with the third semiconductor region opposite to the first electrical contact, wherein the first and second contacts are operable to receive an electric potential such that electrons are emitted from the third semiconductor region.

* * * * *